US009177748B2

(12) United States Patent
Kemp

(10) Patent No.: US 9,177,748 B2
(45) Date of Patent: Nov. 3, 2015

(54) PULSED DEPRESSED COLLECTOR

(71) Applicant: The Board of Trustees of the Leland Stanford Junior University, Palo Alto, CA (US)

(72) Inventor: Mark A. Kemp, Belmont, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 170 days.

(21) Appl. No.: 14/174,637

(22) Filed: Feb. 6, 2014

(65) Prior Publication Data

US 2014/0217885 A1 Aug. 7, 2014

Related U.S. Application Data

(60) Provisional application No. 61/762,205, filed on Feb. 7, 2013.

(51) Int. Cl.
*H01J 25/34* (2006.01)
*H01J 23/027* (2006.01)
*H01J 23/34* (2006.01)

(52) U.S. Cl.
CPC ..... *H01J 23/0275* (2013.01); *H01J 23/34* (2013.01)

(58) Field of Classification Search
CPC ..... H01J 23/0275; H01J 23/34; H01J 23/24; H01J 23/26; H01J 23/027; H01J 25/38; H01J 25/12
USPC ..... 315/30, 3.5, 5.38, 3.6, 235, 241 R, 3; 330/43, 127, 45, 129, 135, 297; 313/293, 447
See application file for complete search history.

(56) References Cited

U.S. PATENT DOCUMENTS 4,101,804 A 7/1978 Carlsson
5,440,202 A * 8/1995 Mathews ..... H01J 23/0275 315/3
5,650,751 A * 7/1997 Symons ..... H01J 25/04 313/293
6,111,358 A * 8/2000 Cardwell ..... H01J 23/0275 315/3.5
6,552,490 B1 4/2003 Cascone et al.
7,888,873 B2 2/2011 Cascone et al.

OTHER PUBLICATIONS

M.A. Kemp, A. Jensen, J. Neilson, "Klystron Modulator System Incorporating a Pulsed Depressed Collector," Plasma Science (ICOPS), 2013 Abstracts IEEE Int'l Conf.; Presented at IEEE Pulsed Power Plasma Science Conf., San Francisco,CA, Jun. 17, 2013-Jun. 21, 2013.

M.A. Kemp, Aaron Jensen, and Jeff Neilson, "Pulsed Depressed Collector for High-Efficiency RF Systems," Presented at the 14th IEEE International Vacuum Electronics Conference (IVEC 2013) Paris, France, May 21-23, 2013.

* cited by examiner

*Primary Examiner* — Lincoln Donovan
*Assistant Examiner* — Thomas Skibinski
(74) *Attorney, Agent, or Firm* — Lumen Patent Firm

(57) ABSTRACT

A high power RF device has an electron beam cavity, a modulator, and a circuit for feed-forward energy recovery from a multi-stage depressed collector to the modulator. The electron beam cavity include a cathode, an anode, and the multi-stage depressed collector, and the modulator is configured to provide pulses to the cathode. Voltages of the electrode stages of the multi-stage depressed collector are allowed to float as determined by fixed impedances seen by the electrode stages. The energy recovery circuit includes a storage capacitor that dynamically biases potentials of the electrode stages of the multi-stage depressed collector and provides recovered energy from the electrode stages of the multi-stage depressed collector to the modulator. The circuit may also include a step-down transformer, where the electrode stages of the multi-stage depressed collector are electrically connected to separate taps on the step-down transformer.

5 Claims, 7 Drawing Sheets

PULSED DEPRESSED COLLECTOR

CROSS-REFERENCE TO RELATED APPLICATIONS

This application claims priority from U.S. Provisional Patent Application 61/762,205 filed Feb. 7, 2013, which is incorporated herein by reference.

STATEMENT OF GOVERNMENT SPONSORED SUPPORT

This invention was made with Government support under contract no. DE-AC02-76SF00515 awarded by the Department of Energy. The Government has certain rights in this invention.

FIELD OF THE INVENTION

The present invention relates generally to RF vacuum electron beam devices. More specifically, it relates to improved depressed collectors for such devices.

BACKGROUND OF THE INVENTION

In RF vacuum microwave devices such as klystrons, an electron beam is manipulated and its kinetic energy is partially converted into RF energy. This process is not fully efficient, and the depleted beam is collected by a collector. Conventionally, the energy deposited into the collector is lost as heat. In pulsed systems, the energy during the rise and fall of a driving pulse (from a modulator) is entirely lost as heat. RF energy is removed only during the flat top portion of the pulse.

There are typically three methods utilized to improve this efficiency. First, the beam to RF conversion efficiency is studied. Research in this area is ongoing, but it requires fundamental changes to the tube technology and potentially has impacts on tube performance. Second, the rise and fall times to the klystron are shortened. This is a very hard parameter to improve upon, especially for high power tubes. Third, a device called a depressed collector can be used.

Depressed collectors in RF amplifiers are a mature and successful technology for efficiency-critical applications such as space applications and UHF broadcast. They are typically employed in low power CW tubes and function by extracting energy from the spent electron beam, shown in FIG. 1. In this example, a spent beam 116 from a klystron device 100 having an output cavity 114 first passes through a reconditioner 102 and then into a depressed collector 118 having five conductive stages 104, 106, 108, 110, 112 that are biased at negative electrical potentials below the kinetic energy of the beam 116. As the beam travels through the depressed collector 118, the electron momentum decreases until collected by a stage. Ideally, the momentum is reduced to zero just as it impacts a collector stage. As less work is required to stop the electrons, this stage biasing and collection of electrons results in reduced heat dissipation in the collector. Effectively, depending upon the stage biasing topology, a portion of the beam power is recovered to some point within the driving modulator/power supply, resulting in a reduced AC power draw. Reduced power draw with the same RF power out results in a higher system efficiency.

The present state-of-the-art in multi-stage collectors can only efficiently recover energy in CW systems. The energy in the rise and fall of pulses is lost. In addition, in conventional depressed collectors, the power supplies are arranged in discharge mode which necessitates driving them to particular potentials.

Many accelerator applications utilize pulsed, high peak power RF systems with duty cycles less than 1%. Typically, a high voltage, pulsed modulator delivers a pulse to the cathode of a klystron. A pulse shape, with rise, flattop, and fall times can be defined as in FIG. 2. Because accelerator applications require high RF phase stability during the pulse, the low level RF input is only applied during the high voltage modulator pulse flat top. Therefore, all of the beam energy during the modulator rise and fall times is wasted and is dissipated as heat in the klystron collector. The amount of energy wasted in the collector is significant for short pulse, low duty cycle systems. For very short pulse applications, this problem is compounded: fast rise and fall times are very hard to achieve in high power modulators.

With a pulsed, high-power system, utilization of a depressed collector to increase system efficiency is not straightforward. The conventional method for applying a pulsed potential to a collector stage is to tap off of the secondary of the output transformer of the modulator. While appropriate for some applications, this approach is not viable for many accelerator applications: it causes deleterious cathode voltage ringing due to parasitic impedances. This ringing translates into RF phase jitter and unacceptable performance.

SUMMARY OF THE INVENTION

In one aspect, the present invention provides a new technique for energy recovery using a pulsed depressed collector on a vacuum electron device RF source. Significantly, energy during the rise and fall times of the pulse can be recovered. In addition, the energy during the RF pulse can also be partially recovered. In short, multiple stages in a collector are allowed to electrically float. With improved pulsed depressed collectors according to embodiments of the invention, the capacitor is charged during the pulse and the collector stage potentials dynamically adjust.

Significant features present in embodiments of the invention include the use of a depressed collector in the charge mode, the use of a pulsed depressed collector, the use of a collector with feed-forward energy recovery, and having a tunable, dynamic collector stage potentials.

In one aspect, the invention is incorporated with a high power RF device which has an electron beam cavity, a modulator, and a circuit for feed-forward energy recovery from a multi-stage depressed collector to the modulator. The electron beam cavity include a cathode, an anode, and the multi-stage depressed collector, and the modulator is configured to provide pulses to the cathode. The circuit is connected to the modulator and to electrode stages of the multi-stage depressed collector. It includes a storage capacitor, or network of capacitors, that dynamically bias potentials of the electrode stages of the multi-stage depressed collector and provides recovered energy from the electrode stages of the multi-stage depressed collector to the modulator. Voltages of the electrode stages of the multi-stage depressed collector are allowed to float as determined by fixed impedances seen by the electrode stages. The circuit may also include a step-down transformer, in which case a high-voltage (primary) side of the step-down transformer is coupled to the multi-stage depressed collector, a low-voltage (secondary) side of the step-down transformer is coupled to the storage capacitor, the storage capacitor is coupled to the modulator, and the electrode stages of the multi-stage depressed collector are electrically connected to separate taps on the step-down transformer.

Applications of embodiments of the invention include vacuum electronics for communications, radar, medical accelerators, and particle accelerators.

This approach provides several significant advantages, including the following:

1) It addresses recovering the energy during the rise and fall times of the pulse. The losses during these times are significant for a large number of existing high power RF sources.
2) The vacuum tube geometry does not need to be altered to incorporate the design of the invention. If there is already a depressed collector on the device, that existing hardware may be used. The self-biasing could then be used in place of the "discharge-mode" biasing that would already be in place. In the case of a conventional, grounded collector, the collector would be modified. In addition, the modulator topology stays the same. A separate tap off can be added.
3) Existing installations can be modified cost-effectively by simply replacing the old klystron with a modified klystron. The modulator does not have to be substantially modified (as would be the case if the beam to RF conversion efficiency is improved for the klystron).
4) This invention is an enabling technology for very short RF pulse applications; in particular high-repetition rate systems. As traditional pulsed systems would deposit significant energy in the collector during the rise and fall times, many RF source operating modes were not achievable. The pulsed depressed collector reduces the energy wasted in the rise and fall times and therefore reduces the deleterious effect of long rise and fall time modulators.
5) New pulse modulators can be produced more cost-effectively or higher-performance by utilizing the pulsed depressed collector. Rather than making design trade-offs to produce fast rise and fall times, because a premium is not placed on minimizing energy transferred during these times, more cost-effective components can be utilized and design effort can be focused elsewhere in the system.

In one embodiment, the stages of the collector are tied to multiple taps on the primary of a step-down transformer. The secondary of the transformer is connected to a capacitor. The output of the capacitor in-turn feeds back to the modulator. During the pulse, the voltages on the collector stages rise up. The voltage they rise to over time is dependent upon the LC circuit defined by the transformer and the capacitor. The closer the potential of the collector to the kinetic energy of the impacting electron, the lower the energy lost to heat. The energy is transferred to the capacitor on the secondary of the transformer. Between pulses, the energy is fed back to the modulator. For the following pulse, this energy can be re-applied to the klystron. Alternatively, instead of recovering the energy to the modulator, the energy can be recovered to the AC mains, or to any other useful point for energy recovery in the system.

DETAILED DESCRIPTION

Figure 1:
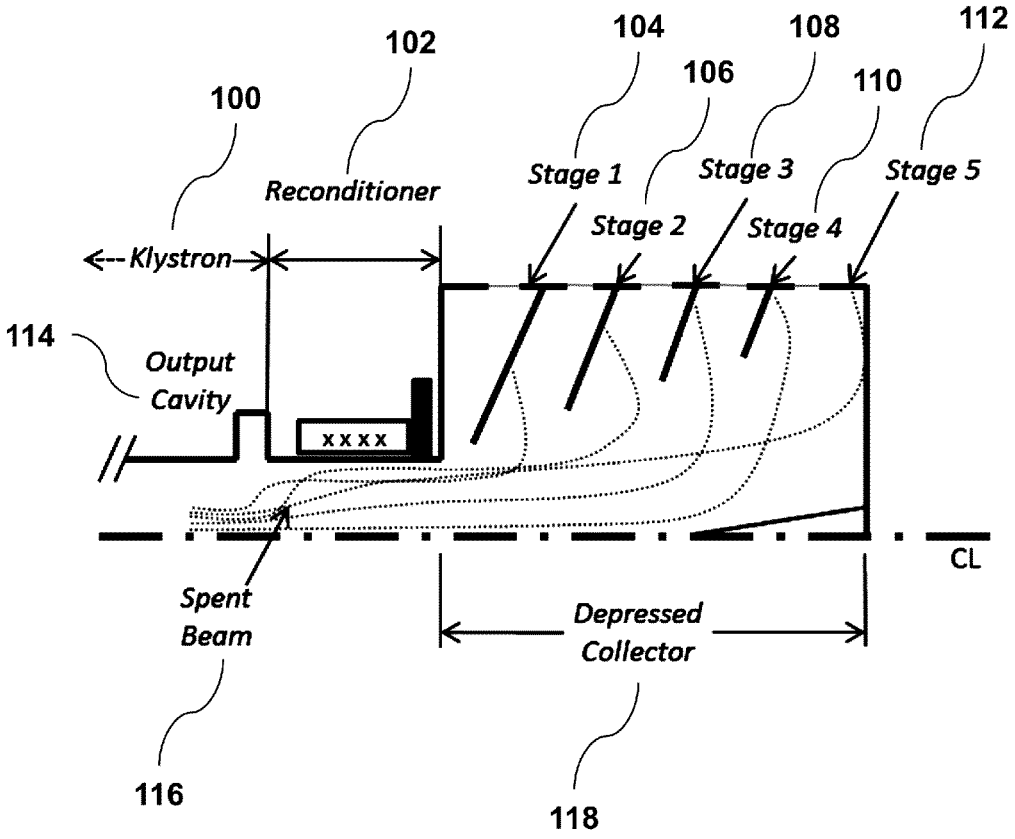
Fig. 1 (Prior Art)
FIG. 1 illustrates a conventional RF power source including a multi-stage collector.
Figure 2:
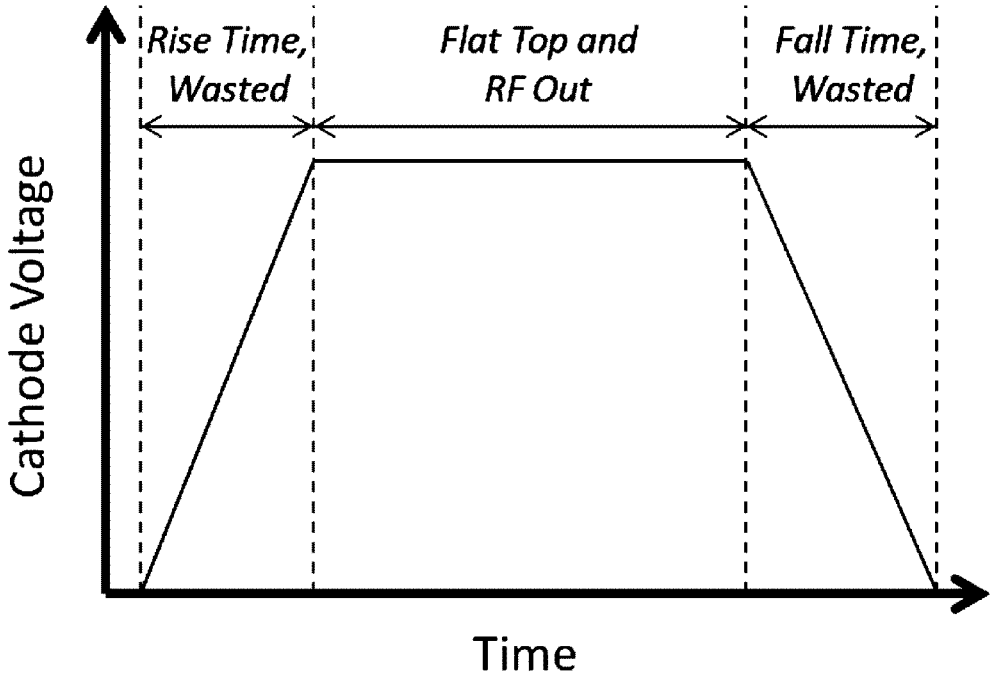
Fig. 2 (Prior Art)
FIG. 2 is a graph of cathode voltage versus time for a conventional pulsed RF power source, illustrating wasted energy during rise time and fall time.
Figure 3:
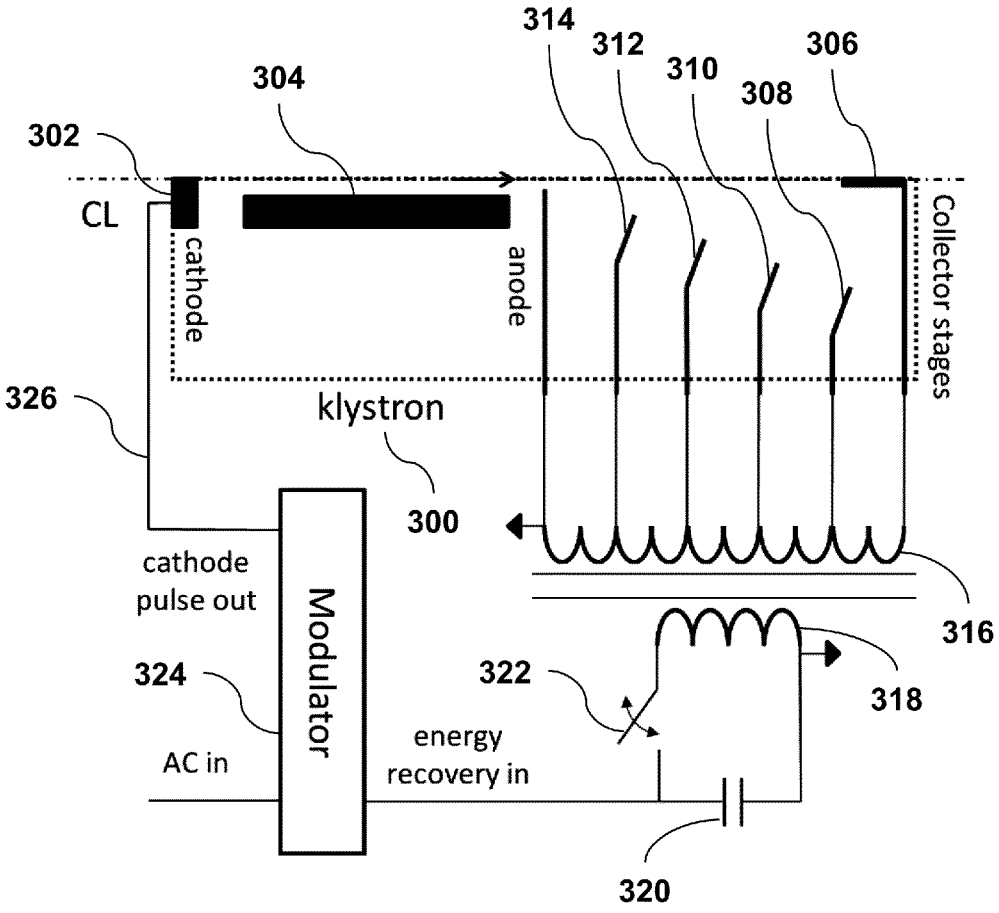
FIG. 3 illustrates an RF power source according to an embodiment of the invention.
Figure 4:
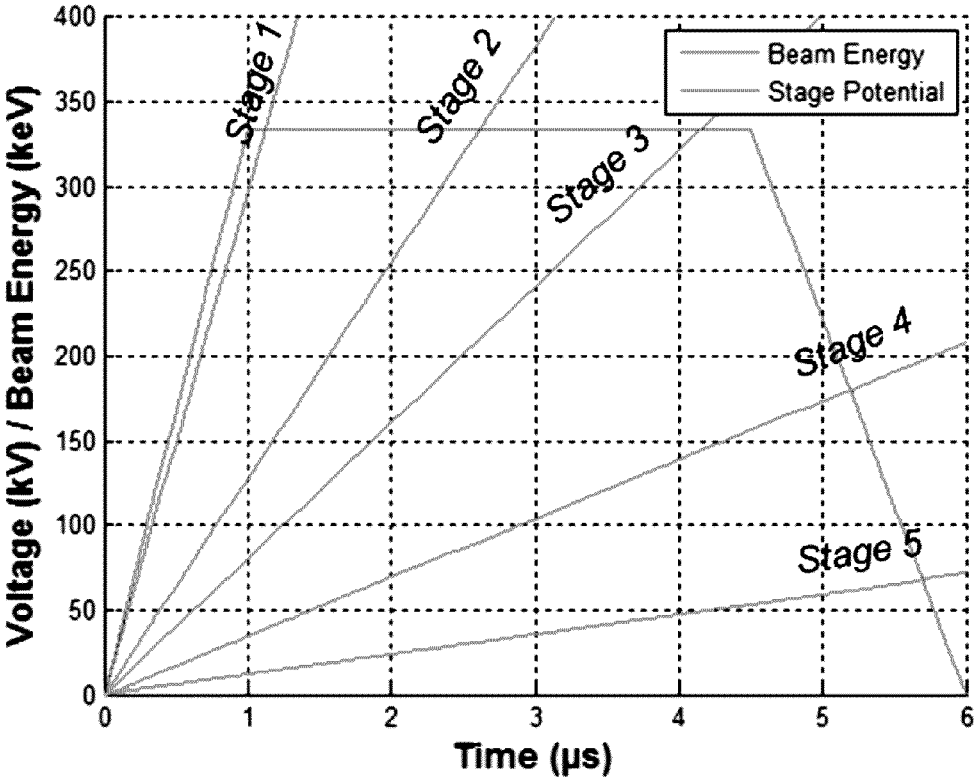
FIG. 4 is a graph of beam energy and stage potentials versus time, according to an embodiment of the present invention.

A vacuum electron RF device including a pulsed depressed collector according to an embodiment of the invention is shown in FIG. 3. In this example, the device includes a klystron 300 which has a cathode 302, klystron circuit 304, and collector stages 306, 308, 310, 312, 314. 3) Although illustrated in detail here for a klystron, the principles of the present invention can be used on almost any vacuum electron device. A modulator 324 connected to cathode 302 by a line 326 is driven by AC power and generates pulses that are applied to the cathode 302. The collector stages are connected to the high voltage end 316 of a step-down transformer whose low-voltage end 318 is connected to a capacitor 320. The transformer and capacitor form an RC circuit to recover energy by dynamically biasing the potentials of the multi-stage depressed collector. Switch 322 serves to isolate the energy that is recovered during the pulse from discharging back through the transformer during the inter-pulse time frame. For some applications, this generic switch can be implemented simply with a diode. At the beginning of a pulse from modulator 324, the potentials of all the stages start at zero voltage. As the spent beam impacts the stages, the stages charge up. The time-varying potential of each collector stage is determined by the current collected by the stages as well as the effective impedance of the step-down transformer and storage capacitor. A simplified charging scheme is shown in FIG. 4. Here the potentials are shown as rising linearly, but in practice, the slopes will change over time and level off After the pulse, the energy from the storage capacitor is recovered back to the modulator for use in the subsequent pulse.

This collector design has several important advantages. Most significantly, the energy during the rising and falling times of the pulse is recovered. This is the first mechanism to accomplish this in a pulsed electron device. This reduces the burden on the modulator to produce very fast pulse edges, thereby simplifying the overall design and cost. The energy is recovered in a feed-forward mechanism and can be "slowly" recovered for use on the next pulse. Also, if desired, it could be recovered back to the AC power grid. For example, a DC/AC converter may be placed in-between the energy recovery capacitor 320 and the AC line entering the modulator 324.

Another advantage is that existing systems can be retrofitted. The modulator 324 provides the same output pulse as it would have without the depressed collector. Because the stage biasing mechanism is separate from the mechanism to drive energy through the RF source, the depressed collector is effectively decoupled from the driving modulator. Cathode ringing is not possible. Moreover, the self biasing concept is independent of collector geometry. For example, to upgrade accelerator devices, the modulator stays the same and only the collector on the existing klystron is changed.

In addition, this recovery method can be used with any known modulator configuration. It does not require a modulator with an output transformer, as is the case if one just tapped off the secondaries of the modulator transformer to bias the stages. This opens up the application to many modern topologies and does not inhibit someone from upgrading the modulator at a later date, while keeping the same RF source.

This method of energy recovery also does not change the effective impedance seen by the modulator. Therefore, for various operating conditions and throughout the pulse, the impedance doesn't change. This reduces reflections and simplifies the modulator configuration.

This concept decouples the recovery mechanism from the mechanism that applies power to the cathode. This is beneficial in low phase-noise applications which require a stiff and repeatable cathode voltage during the pulse.

Another advantage is that additional high voltage bias supplies are not necessary since it is self-biasing. This lessens the expense of adding additional collector stages. In addition, availability should increase because of the reduced number of power components.

Figure 5:
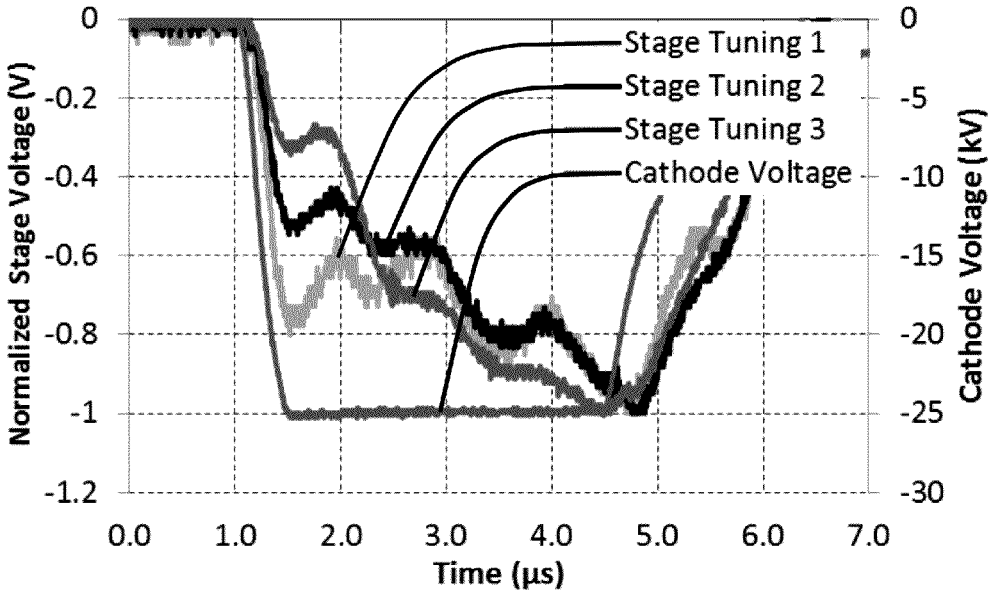
FIG. 5 is a graph of normalized stage voltage and cathode voltage versus time, according to an embodiment of the invention.

Changing the biasing impedances also changes the shape and magnitude of the stage potential. In contrast to the simple straight line biasing shown in FIG. 4, a more efficient collector results from a "square" biasing potential waveform as shown by "Stage Tuning 1" in FIG. 5. This demonstrates the ability to control the stage biasing via external passive impedances. "Stage Tuning 2" and "Stage Tuning 3" are examples of the different biasing voltage shapes which can be achieved by simply changing the load capacitance, and therefore the impedance viewed by the stage. In effect, the parasitic elements of the transformer in conjunction with the load impedance shapes the pulse temporally.

Figure 6:
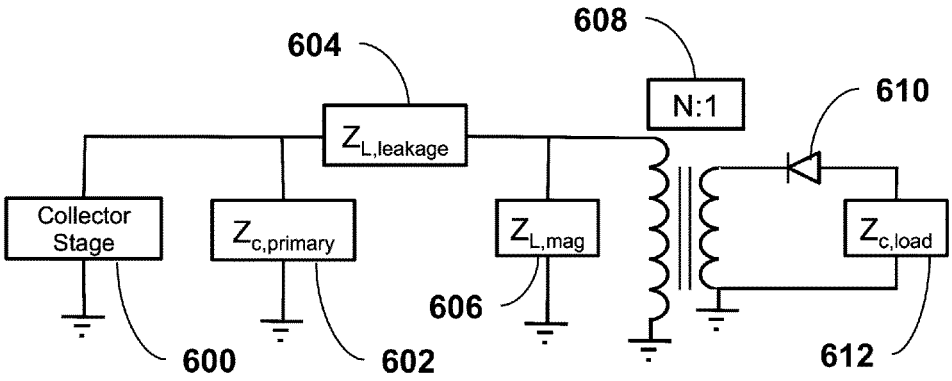
FIG. 6 is a schematic of a circuit illustrating biasing impedances, according to an embodiment of the invention.

The biasing impedances used in one embodiment are shown in FIG. 6. Collector Stage 600 represents the current source driving the biasing network simplified into transformer primary capacitance 602, transformer leakage inductance 604, transformer magnetizing inductance 606, ideal transformer turns ratio 608, isolation diode 610, and energy recovery capacitance 612. Although they are not all completely independent, the values can be easily altered to affect collector efficiency. For example, the load capacitance can be swept over a range of values. A solid state switch or relay can be used to switch in or out capacitors in a series/parallel array. The effective capacitance of that array determines the shape and magnitude of the stage bias voltage.

Also, the energy recovery capacitance can be changed for various operating conditions to optimize the energy recovery. For example at low RF power output, the capacitance can be dynamically raised to recover more energy at an optimal bias point. In general, it is preferable to reduce the momentum of the spent electron beam as much as possible, without steering back down the RF tube's beam pipe. If there are many stages, they are strategically biased to get the most energy recovery possible. In using the biasing scheme of the present invention, the time-varying potential on those stages is partially controlled by the value of the capacitance. For example, if not extracting at RF energy from the tube, most of the energy that was put into the tube from the modulator remains in the spent beam. In addition, it is nearly mono-energetic. Therefore, it would be preferable to have a high value of capacitance to keep the stage potentials from rising too-quickly: more energy is being collected by the stages. On the flip side, if the tube is generating output RF, the spent beam has a spectrum of energy, and is, on the whole, less energetic. Therefore, a lower capacitance would be used. Computer programs may be used to optimize this behavior.

In some embodiments, the storage capacitor can be "pre-charged" to a certain value to allow the biasing potentials on the collector to quickly rise to the transformer ratio times the capacitance voltage level. This produces a square pulse and can be used for fast rise-time systems. This also benefits passive, resonant recharge of the modulator filter capacitance from the energy recovery capacitance. The pre-charged value is preferably selected such that the stage potentials rise quick-enough to get up to an appropriable-high bias level during the pulse, but not too fast such that the rise time energy can still be recovered.

Figure 7:
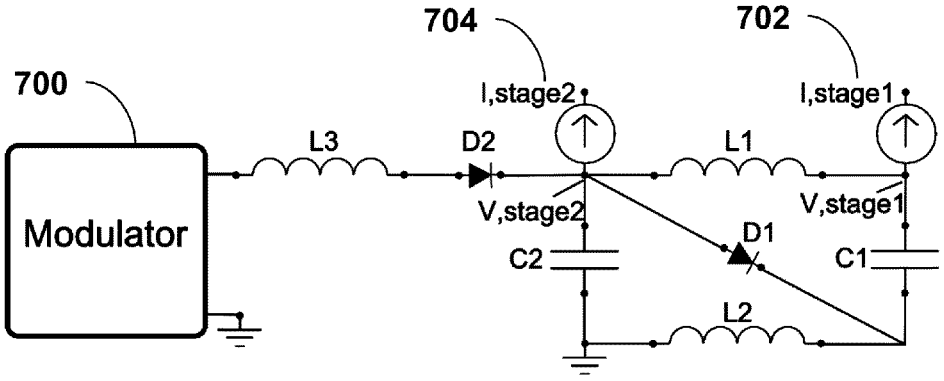
FIG. 7 is a schematic of an energy recovery circuit without a transformer, according to an embodiment of the invention.

In some embodiments, a transformer is not used to assist in the stage biasing. Instead, capacitors are effectively positioned directly across the stages. FIG. 7, for example, illustrates one example of a circuit used to provide recovery without a transformer. The circuit connects a modulator 700 to stages 702, 704. This is a two stage version, but it can be extended for any number of stages. This is also an example of an "inverse Marx" topology: the storage capacitors C1, C2 are charged in series and discharged in parallel. During the main pulse, the currents collected in the stages 702 and 704 are represented by the current sources, I, stage1 and I, stage2, respectively. The current pulse is short enough such that inductors L1, L2, and L3 have a very large impedance. The recovered current, therefore, flows though C1, D1, and C2, charging the capacitors. In the relatively long time between pulses, L1, L2, and L3 have a relatively low impedance and the recovered energy flows though D2 back to the modulator.

In this case, L1, L2, and L3 act as "switches" during the pulse. However, actual solid-state or gas switches can be used in their place. The advantage in using actual switches is that the pulse can be arbitrarily long without requiring very large discharge chokes (L1, L2, L3). The disadvantage is that the switches need to hold off the same voltage that is across the biasing capacitor for that stage.

The capacity of the capacitor determines the bias voltage for the stage as well as the rate that it changes over time for a given recovered current.

Figure 8:
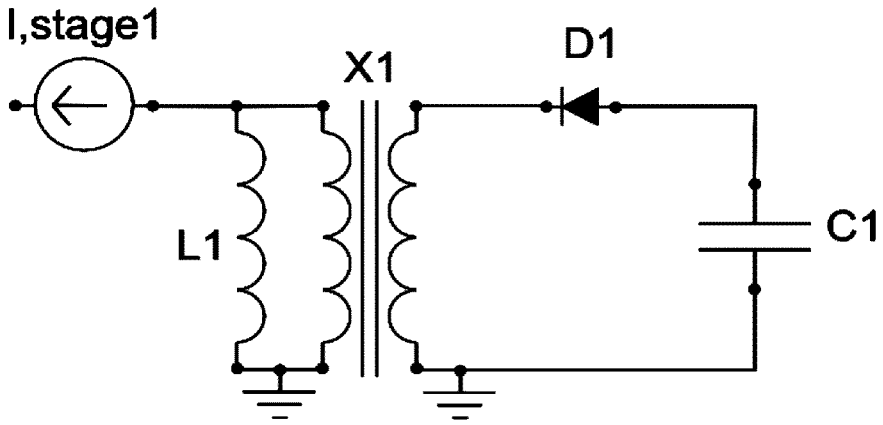
FIG. 8 is a schematic of a circuit used to recover both polarities of post-pulse oscillations, according to an embodiment of the invention.
Figure 9:
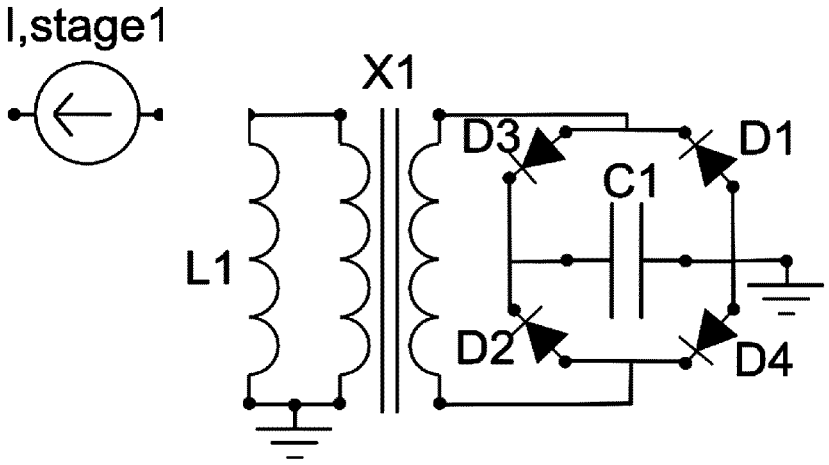
FIG. 9 is a schematic of a circuit used to recover positive oscillations, according to an embodiment of the invention.

In some embodiments, the energy stored in the energy recovery transformer magnetizing inductance during the pulse can be recovered during the post-pulse oscillations. This can be improved further by adding another switch to recover both polarities of the oscillation. In the simplest case, the switch is just a set of diodes. In FIG. 8, only one polarity of current is collected. This works fine, except that the parasitic magnetizing inductance, L1, of the transformer builds up energy during the pulse, after the pulse, this inductance oscillates with the recovery capacitance, C1, as well as any other stray capacitance such as the winding capacitance. Eventually, either this energy is recovered (during negative oscillations) in C1, or it is wasted as heat in the transformer. To recover positive oscillations as well, a full bridge rectifier can be used, as shown in FIG. 9. This increases the efficiency achievable for the collector system.

In some embodiments, rather than a resonant recharge of the modulator from the energy recovery capacitance, a Marx-type arrangement can be used as the energy recovery capacitance. This allows one to recover to a higher voltage (allowing a lower turns ratio transformer). This has the advantage of potentially reducing the leakage and magnetizing inductance of the transformer, thereby increasing the overall efficiency.

FIG. 7, for example, illustrates the case with a Marx-type recovery scheme without a transformer. The inverse Marx can be used with a transformer as well. In addition, another way to transfer the recovered energy to the modulator is using a switch-mode converter such as a buck converter. Those skilled in the art will appreciate that a large number of combination of possible converters can be used here.

In general, the present invention encompasses feed-forward energy recovery methods for a depressed collector. Although specific methods to recover energy for use on pulsed RF sources have been described in detail, the scope of the invention is not envisioned to be limited to those specific implementations.

The invention claimed is:

1. A high power RF device comprising:

an electron beam cavity having a cathode, an anode, and a multi-stage depressed collector;

a modulator configured to provide pulses to the cathode; and a circuit connected to the modulator and to electrode stages of the multi-stage depressed collector, wherein the circuit comprises a storage capacitor that dynamically biases potentials of the electrode stages of the multi-stage depressed collector and provides recovered energy from the electrode stages of the multi-stage depressed collector to the modulator.

2. The device of claim 1 wherein the circuit further comprises a step-down transformer.

3. The device of claim 2 wherein a high-voltage (primary) side of the step-down transformer is coupled to the multi-stage depressed collector, wherein a low-voltage (secondary) side of the step-down transformer is coupled to the storage capacitor, and wherein the storage capacitor is coupled to the modulator.

4. The device of claim 2 wherein the electrode stages of the multi-stage depressed collector are electrically connected to separate taps on the step-down transformer.

5. The device of claim 1 wherein voltages of the electrode stages of the multi-stage depressed collector are allowed to float as determined by fixed impedances seen by the electrode stages.

* * * * *